US005943779A

United States Patent [19]

Antonio, Jr.

[11] Patent Number: 5,943,779

[45] Date of Patent: Aug. 31, 1999

[54] ERGONOMIC CUTTING DEVICE

[76] Inventor: Robert Antonio, Jr., 225 E1 Dorado Dr., Pacifica, Calif. 24044

[21] Appl. No.: 08/933,225

[22] Filed: Sep. 18, 1997

[51] Int. Cl.[6] ..... B26B 13/00

[52] U.S. Cl. ..... 30/248; 30/249

[58] Field of Search ..... 30/235, 248, 249, 30/250, 251, 254, 257, 259, 260, 261, 262, 232

[56] References Cited

U.S. PATENT DOCUMENTS

| | | | |
|---|---|---|---|
| 2,326,178 | 8/1943 | Seeberger | 30/250 |
| 3,438,130 | 4/1969 | Ballard et al. | 30/235 |
| 3,775,846 | 12/1973 | Johnson | 30/262 |
| 4,534,109 | 8/1985 | Bush et al. | 30/260 |
| 4,715,122 | 12/1987 | Linden | 30/254 |
| 4,958,435 | 9/1990 | Grubbs et al. | 30/249 |
| 5,092,049 | 3/1992 | Grubbs et al. | 30/249 |
| 5,179,783 | 1/1993 | Melter | 30/262 |
| 5,193,277 | 3/1993 | Zmijewski | 30/257 |
| 5,325,592 | 7/1994 | Linden et al. | 30/254 |
| 5,341,573 | 8/1994 | Linden et al. | 30/254 |
| 5,353,505 | 10/1994 | Okada | 30/253 |
| 5,375,401 | 12/1994 | Flickinger | 56/239 |
| 5,377,412 | 1/1995 | Schofield et al. | 30/262 |
| 5,426,857 | 6/1995 | Linden | 30/262 |
| 5,502,897 | 4/1996 | Rauch | 30/257 |
| 5,551,157 | 9/1996 | Wu | 30/251 |
| 5,570,510 | 11/1996 | Linden | 30/250 |

*Primary Examiner*—Hwei-Siu Payer

[57] ABSTRACT

An improved, ergometric cutting device is disclosed having a tapered handle distending laterally outward from a flat bottom portion and forming an acute angle to a blade assembly. The handle is further supports a trigger that is linked to a blade assembly that is formed of a weighted, pivoting upper blade and a stationary lower blade. A linkage arm and adjustment knob are further provided in affixing the blade assembly to the handle.

5 Claims, 4 Drawing Sheets

-PRIOR ART-

ERGONOMIC CUTTING DEVICE

BACKGROUND OF THE INVENTION

1. Field of the Invention

The present invention relates generally to hand actuated cutting tools, and, more particularly, to an improved, more efficient, ergonomic cutting device.

2. Description of the Related Art

Almost every household in America owns a pair of pivoted cutting devices, such as the traditional utility scissors. These devices are used to cut paper, fabric, and innumerable other uses. Examples of the previous art include U.S. Pat. No. 5,341,573, issued in the name of Linden et al., U.S. Pat. No. 4,534,109, issued in the name of Bush et al., U.S. Pat. No. 4,715,122, issued in the name of Linden, and U.S. Pat. No. 5,325,592, issued in the name of Linden et al.

There are numerous problems with the utility scissor devices of the previous art. These devices require a hand strength, finger strength and articulation, endurance and wrist flexibility to operate, abilities that many individuals do not possess. There are an estimated forty million individuals with conditions that limit hand and wrist strength and flexibility, such as arthritis, carpal tunnel syndrome, and repetitive strain injury. For these people, using these devices is difficult, painful, and in some instances, impossible. These devices can be difficult for children and the elderly to use, given that members of both groups may have less muscle strength and coordination than the public at large.

The first major problem with these devices is that they require use of the wrist in an unnatural, non-neutral, cramped position with the wrist and arm at a downward angle. This causes several problems. The awkward hand position can cause misalignment of the tendons in the wrist, increasing the chances of injury, and making usage of the device uncomfortable. Also, power transfer from the forearm to the fingers is not efficient.

Second, these devices require the operator to perform an articulated pinching motion with the fingers to both open and close the blades. This motion is difficult and awkward for many people, especially those with hand and arm related medical conditions, such as the young and the elderly.

Third, these devices utilize a pinching blade action, which requires a large amount of energy and can produce a cut that is not 'clean.'

Fourth, because the lower blades on these devices are not stationary, the device cannot be used while resting on a table. Thus, the operator must support the weight of the device during usage. The devices do not stand up on their own, which requires the user to keep the device in the upright position during usage. Performing these tasks can be difficult for many individuals, as explained above.

Fifth, these devices utilize 'loops' into which the operator inserts his/her fingers. This configuration does not readily accommodate larger hands.

Sixth, these devices require an operator to be able to reopen the blades without any assistance from the device. This places a great strain on the muscles of the hand, wrist and arm which are needed to open the scissors and are weaker than the muscles used to close the devices.

Seventh, some of these devices are designed to be used by only right handed individuals. The '573 device discloses this problem. The '573 device's design causes problems for the millions of left-handed individuals in the United States of America.

Attempts have been made to correct for the foregoing problems, but no device has successfully dealt with all these problems. For example, U.S. Pat. No. 5,377,412, issued in the name of Schofield, et al, discloses a pivoted cutting device that provides room for larger hands by enlargement of the loops of the previous devices. However, no device in the previous art successfully deals with all the problems discussed above.

Furthermore, a search of the previous art did not disclose any patents that read directly on the claims of the instant invention. Consequently, a need has been felt for providing an apparatus which overcomes all of the cited problems.

SUMMARY OF THE INVENTION

It is therefore an object of the present invention to provide an improved cutting device that eliminates the problems associated with previous pivoted cutting devices, such as traditional scissors. The present invention is an improved, ergonomic cutting device with a trigger design, comprising a tapered handle, a flat bottom with a stationary lower blade, a weighted upper blade which produces a slicing action similar to that of a knife, an adjustment knob for setting the desired 'throw,' and clearance channels.

In accordance with a preferred embodiment, it is a feature of the present invention to incorporate a trigger design which encourages the operator to maintain his/her hand and wrist in a neutral wrist position during use, thereby increasing comfort and efficiency of power transfer from the forearm to the fingers. Another advantage of this feature is that strain on the tendons of the wrist are minimized, thereby, reducing the chance of resultant injury.

Another feature of the present invention is that it is operated in the power grip position, which requires the operator to simply close his/her hand like a fist. Unlike the articulated pinching action that one must perform to operate traditional scissors, output force is maximized by using the four fingers in unison. In addition, this is a very efficient and simple grip for either the elderly or the young to use.

Another feature of the present invention includes a spring loaded return, which provides spring assistance while reopening the blades. The advantage of this design is that it helps the much weaker 'opening muscles' of the hand, which are the first to fatigue, and helps reduce the familiar scissor cramp.

Another feature of the present invention includes spring assistance which incorporates the flexibility and memory of flexible plastic. Using plastic results in two advantages. First, metal springs are eliminated. Metal springs can rust and break, inadvertently resulting in injury to the user. Second, the part count is reduced because there are no related fasteners or mounting point as is common with metal spring devices. This reduces the number of assembly steps, which reduces production time and cost.

Another feature of the present invention is that its upper blade has a large mass and features an offset pivot point. These two features produce a more efficient slicing action, much like a knife. This produces two advantages. First, the present invention produces a cleaner cut than the devices of the previous art. Second, using the present invention requires less effort than the pinching blade action produced by traditional scissors.

Another feature of the present invention is its wide bottom, which allows the device to stand up and helps the user keep it in the upright position during usage.

Another feature of the present invention is its stationary lower blade, which allows operation with the tool resting on a surface such as a table. This relieves the user from having to support the weight of the device during use.

Another feature of the present invention is that it accommodates hands of different sizes in three ways. First, the present invention does not utilize loops, which do not allow entry to larger hands. Second, the tapered handle helps larger hands feel more security at the wider top end while the smaller diameter of the lower end helps smaller hands feel more security. Third, the oversized adjustment knob controls the amount of 'throw' in the trigger, allowing further adjustments to hand sizes.

Another feature of the present invention is that it accommodates both left and right handed users. This allows the millions of left-handed people in America to use the same cutting device as the right-handed people. Thus, costs to consumers with members of both hand designations are decreased.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENTS

Figure 1:
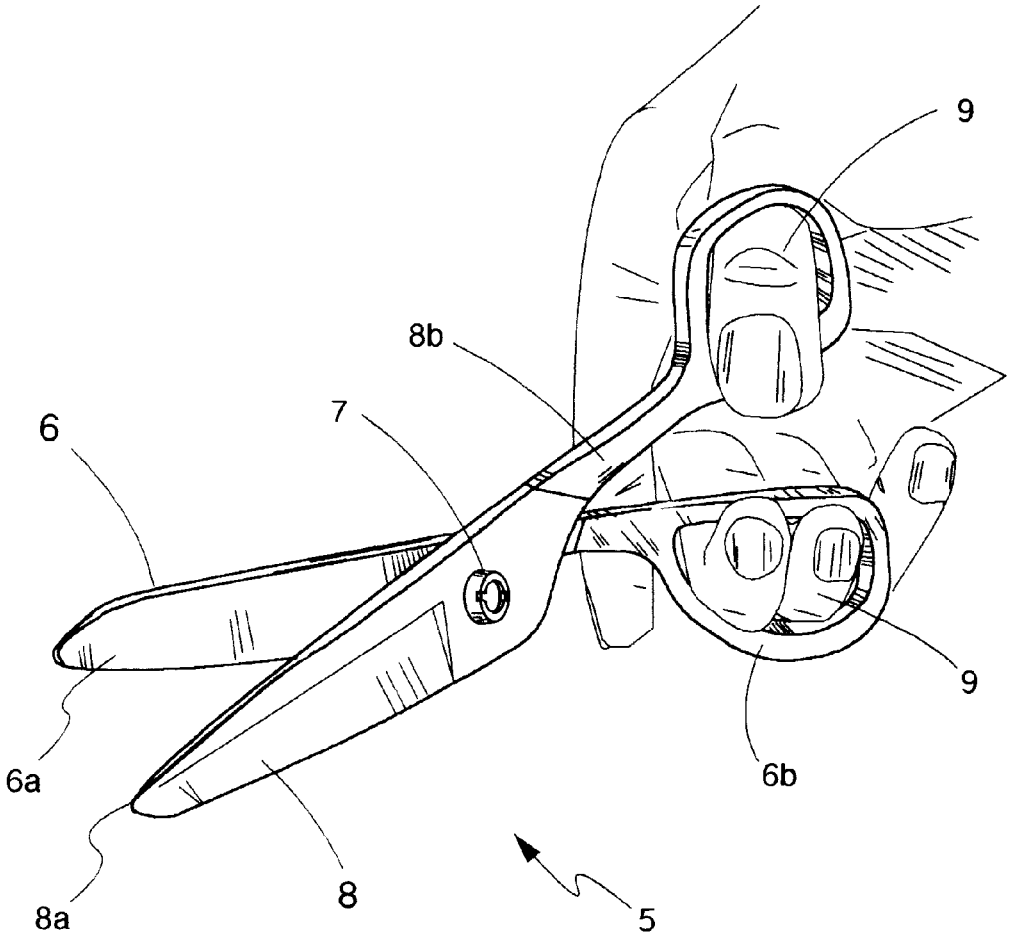
FIG. 1 is a perspective view of the prior art, represent by a conventional scissors.

Referring now to FIG. 1, a typical embodiment of the prior art is shown depicted as a conventional scissor 5, shown here including a first blade 6 articulating about a central pivot 7 which connects to a second blade 8. Each blade 6, 8 forms a conventional lever having a blade section 6*a*, 8*a* opposed to a handle section 6*b*, 8*b*. Each handle section 6*b*, 8*b* generally terminates in a finger gripping hole or loop 9, generally adapted to receive either a user's thumb, forefinger, index finger, or a plurality of fingers.

Figure 2:
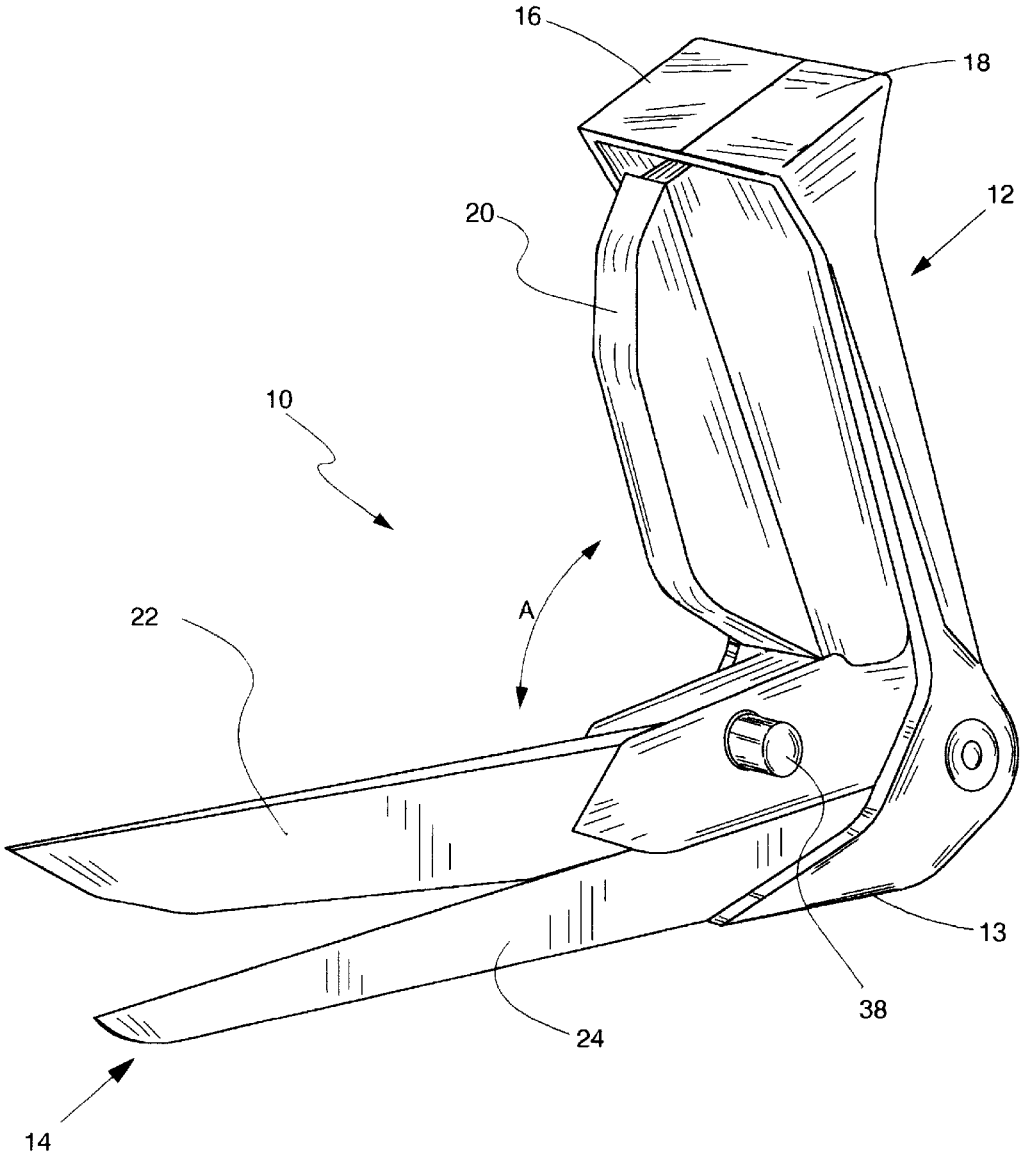
FIG. 2 is a perspective view of the improved, ergonomic cutting device according to the preferred embodiment of the present invention, shown herein fully assembled.

Referring now to FIG. 2 for purposes of similarity and difference, a perspective view of a cutting device 10 is shown, according to the preferred embodiment of the present invention, comprised of a handle 12 extending longitudinally and vertically, but at acute angle A, from a flat bottom portion 13. It is envisioned that a variety of angles may be formed with adequate result; however, in order to achieve a majority of the benefit of the current disclosure it is felt that an angle less than or equal to perpendicular is desired. The handle 12 is further formed of a right body half 16, a left body half 18, and a trigger 20. The blade assembly 14 is formed of a weighted, pivoting upper blade 22 and a stationary lower blade 24. A linkage arm 36 and adjustment knob 38 are further provided in affixing the blade assembly 14 to the handle 12 in the manner more fully described in conjunction with the disclosure provided below.

Figure 3:
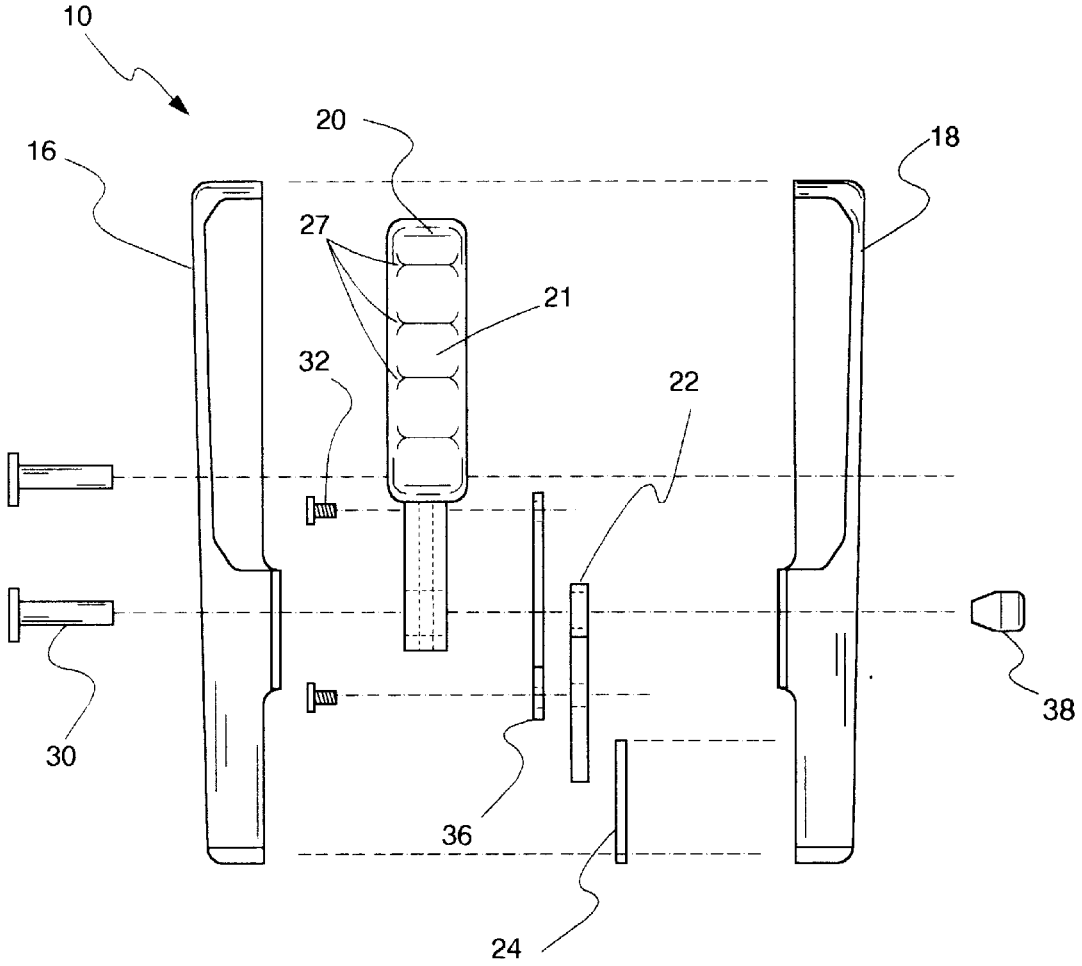
FIG. 3 is a front plan view thereof, shown herein disassembled.

A shown best in FIG. 3, the top plan view of the disassembled cutting tool 10 in its component parts. The handle 12 is formed of a right body half 16 connected to a symmetrically design left body half 18. Each body half 16, 18 is designed such that, when joined, the flat bottom portion 13 is formed, providing a widened surface that can function as a stand or base to support the cutting tool 10 in an upright, freestanding manner. In its preferred embodiment, it is felt that each body half would be injection molded of santoprene plastic. The trigger 20 includes a gripping section 21 and further forming a spring protrusion 23 extending outward opposite the gripping section 21. It is envisioned that the gripping section 21 can include frictional ridges 27, as shown, to increase hand gripping friction; however, such a structure, although desired, is not strictly necessary. The entire trigger 20, in its preferred embodiment, is comprised of injection molded plastic, preferably polycarbonate. Although other materials are possible, it is felt that injection molded polycarbonate would provide a superior commercial embodiment. It is envisioned, however, that further material combinations may be preferred to accommodate various commercial potentialities.

The blade assembly 14 is formed of a weighted, pivoting upper blade 22 and a stationary lower blade 24. It is envisioned that these portions of the cutting tool 10 would be formed to stamped, sharpened stainless steel. Any other blade technology can be incorporated, either from conventionally available scissors, knives, or cutting tools. It is envisioned that the lower blade 24 would be affixed within the handle 12, and the upper blade 22 would include a linkage affixment point 26, located below the longitudinal axis of the blade 22, and an offset pivot point 28, located above the longitudinal axis of the blade 22 and between the linkage affixment point 26 and the rear of the upper blade 22.

Figure 4:
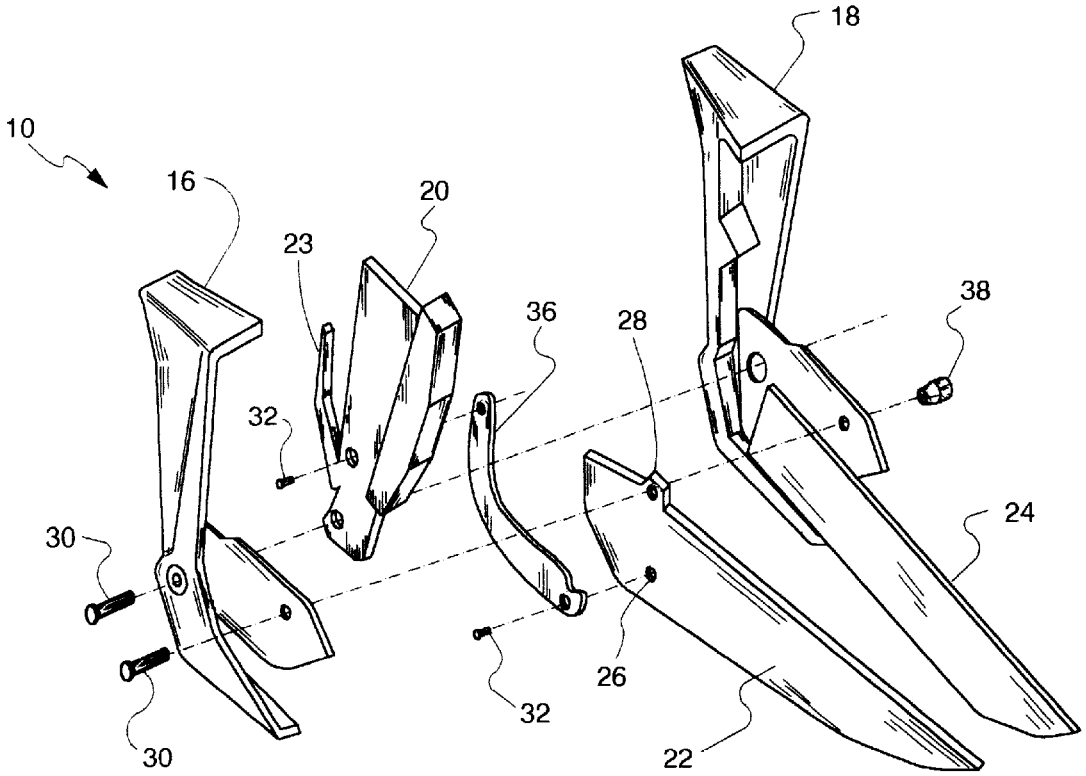
FIG. 4 is an exploded perspective view thereof.

Referring now to FIG. 4, the exploded view of the cutting tool 10 is shown. The lower blade 24 is affixed to the inside of the left body half 18. The right body half 16 is attached to the left body half 18 via a pair of body screws 30. Pivotally retained within the body halves 16, 18 is the trigger 20, which is pivotally retained to the left body half 18 by one of the body linkage screws 30. A linkage arm 36, envisioned as an elongated metal member, provides physical communications between the trigger 20 and the upper blade 22. The linkage arm 36 is pivotally affixed at one end to the trigger 20, and pivotally affixed at the other end to the lower blade 24. Each point of pivotal affixment is envisioned as a linkage screw, rivet, or other similar conventional fastener 32.

An adjustment knob 38, threadably attached to a body screw 30, allows the user to adjust the clamping force exerted on the linkage arm 36 and hold together the right body half 16 to the left body half 18. In its preferred embodiment, it is felt that by forming the adjustment knob 38 of injection molded plastic, the above listed feature and benefits can be achieved with cost effective manufacturing.

The foregoing description is included to illustrate the operation of the preferred embodiment and is not meant to limit the scope of the invention. Exact methods of manufacture and materials of construction for individual component elements are disclosed as illustrative of the best current mode of implementation of the present disclosure, and not meant as a limitation on the present teachings. Therefore, the scope of the invention is to be limited only by the following claims.

What is claimed is:

1. A cutting device comprising:

a handle assembly having a left body half connected to a generally symmetrical right body half by at least one body screw;

a lower blade attached rigidly to said handle assembly, extending therefrom in a generally perpendicular direction, forming an acute angle between said lower blade and said handle assembly;

an upper blade attached pivotally to said handle assembly, through said left body half and said right body half, by a blade pivotal affixment, parallel and adjacent to said lower blade, and extending from said handle assembly in a generally perpendicular direction, forming an acute angle between said upper blade and said handle assembly the degree of which varies as said upper blade rotates about said blade pivotal affixment in an arcuate motion;

a trigger attached pivotally to said handle assembly by a trigger pivotal affixment, said trigger having a spring protrusion that serves to bias said trigger against said handle assembly and forcing said trigger to protrude from said handle assembly, wherein force can be applied to said trigger against the biasing force of said spring protrusion, causing said trigger to rotate about said trigger pivotal affixment in an arcuate motion; and a linkage arm having a first end opposite a second end, attached pivotally to said upper blade at said first end and attached pivotally to said trigger at said second end, providing physical connection between said trigger and said upper blade wherein actuation of said trigger about said trigger pivotal affixment causes the actuation of said upper blade about said blade pivotal affixment.

2. The cutting device of claim 1 further comprising an adjustment knob consisting of a threaded fastener that threadably attaches to said blade pivotal affixment, the rotation of said adjustment knob causing the clamping force exerted on said linkage arm by said left body half and said right body half to be adjusted to a desired level.

3. The cutting device of claim 1 wherein said handle assembly further comprises a bottom portion having a generally flat surface upon which said cutting device can rest on a flat surface in an upright manner, oriented such that said handle assembly extends vertically therefrom.

4. The cutting device of claim 1 wherein said spring protrusion biases said upper blade and said lower blade in an open position with respect to one another.

5. The cutting device of claim 1 wherein said trigger further comprises a series of fricitonal ridges forming a grip enhancing means.

* * * * *